US007150269B2

(12) United States Patent
de Monts de Savasse et al.

(10) Patent No.: US 7,150,269 B2
(45) Date of Patent: Dec. 19, 2006

(54) FUEL PUMP MODULE HAVING A FUEL FILTER WATER DRAIN

(75) Inventors: Humbert de Monts de Savasse, Reims (FR); Pascal Perruchot, Saint Martin sur le pré (FR)

(73) Assignee: Marwal Systems s.a.s., Châlons en Champagne (FR)

( * ) Notice: Subject to any disclaimer, the term of this patent is extended or adjusted under 35 U.S.C. 154(b) by 193 days.

(21) Appl. No.: 11/008,476

(22) Filed: Dec. 9, 2004

(65) Prior Publication Data

US 2005/0133430 A1 Jun. 23, 2005

(30) Foreign Application Priority Data

Dec. 22, 2003 (FR) ..... 03 15141

(51) Int. Cl.
*F02M 37/00* (2006.01)
*F02M 37/04* (2006.01)

(52) U.S. Cl. ..... 123/510; 123/509; 123/514

(58) Field of Classification Search ..... 123/509, 123/510, 514, 549, 557; 210/248, 33, 541
See application file for complete search history.

(56) References Cited

U.S. PATENT DOCUMENTS 4,933,093 A * 6/1990 Keller ..... 210/774
5,103,793 A 4/1992 Hubbell et al.
5,368,001 A 11/1994 Roche
5,404,585 A * 4/1995 Vimpari et al. ..... 455/115.1
5,606,989 A * 3/1997 Roll et al. ..... 137/203
5,649,514 A 7/1997 Sincmiya et al.
5,958,237 A 9/1999 Cort
6,264,831 B1 * 7/2001 Hawkins et al. ..... 210/86
6,361,684 B1 * 3/2002 Hawkins et al. ..... 210/91
6,793,818 B1 * 9/2004 Entringer et al. ..... 210/238

FOREIGN PATENT DOCUMENTS

| | | |
|---|---|---|
| EP | 1154149 | 11/2001 |
| JP | 60122266 | 6/1985 |
| JP | 2002/070680 | 3/2002 |
| WO | WO 01/96731 | 12/2001 |
| WO | WO 03/067068 | 8/2003 |

* cited by examiner

*Primary Examiner*—Thomas Moulis
(74) *Attorney, Agent, or Firm*—Reising, Ethington, Barnes, Kisselle, P.C.

(57) ABSTRACT

A fuel pump module adapted for mounting within a fuel tank and including an inlet, an outlet downstream of the inlet, and a fuel pump downstream of the inlet and upstream of the outlet. A fuel filter chamber is downstream of the fuel pump and includes a fuel filter disposed therein having an upstream side and a downstream side. A filter drain conduit is in fluid communication with the fuel filter chamber at the upstream side of the fuel filter and extends externally of the fuel pump module and fuel tank. The filter drain conduit may be in fluid communication with the filter chamber substantially at a lower portion of the fuel filter, and may include a valve located externally of the fuel tank. A heating device may be provided in the fuel filter and a recirculation device may be provided in the drain conduit.

20 Claims, 3 Drawing Sheets

FUEL PUMP MODULE HAVING A FUEL FILTER WATER DRAIN

CROSS-REFERENCE TO RELATED APPLICATIONS

Applicants claim right of priority of French Patent Application FR 03 15141 filed on Dec. 22, 2003.

FIELD OF THE INVENTION

The invention relates to fuel tanks and fuel filters, and more particularly to a fuel tank with a fuel pump module having a fuel filter water drain.

BACKGROUND OF THE INVENTION

Various types of fuel filters have been proposed to extract soluble and non-soluble water in fuel. Fuel, especially diesel fuel, typically has a certain quantity of water in soluble form that may hinder performance of an engine. Fuel also usually has a certain quantity of water in non-soluble form, which tends to be created during transport and storage of the fuel.

A conventional diesel fuel filter typically includes a fine paper that separates water from fuel by coalescence so that the fuel may pass downstream to the engine with little to no water entrained therein. Over time, however, water accumulates on the surface of the fuel filter and the level of the accumulated water rises and clogs an ever increasing surface area of the filter. The rising level of accumulated water thereby impedes fuel flow therethrough and creates a pressure drop thereacross. This blockage and pressure drop tends to slow down the passage of fuel through the filter and can lead to gradual or sudden releases of water from the filter to the engine.

Therefore, a conventional diesel fuel filter must be mounted in an accessible location on a vehicle for servicing by a mechanic. After accessing the fuel filter, the mechanic removes plugs or opens valves thereof, and then pumps water out of a drain hole of the filter while allowing make up air to enter the filter through a vent hole thereof. Finally, the mechanic refills the filter with fuel, and replaces the plugs or closes the valves. Unfortunately, such a conventional diesel fuel filter cannot be located within a relatively inaccessible location within a fuel tank because of the need for a mechanic to easily access, drain, and refill the filter.

SUMMARY OF THE INVENTION

A fuel pump module is adapted for mounting within a fuel tank and includes an inlet, an outlet downstream of the inlet, and a fuel pump downstream of the inlet and upstream of the outlet. The fuel pump module further includes a fuel filter chamber downstream of the fuel pump and a fuel filter disposed within the fuel filter chamber and having an upstream side and a downstream side. The fuel pump module also includes a filter drain conduit in fluid communication with the fuel filter chamber substantially at the upstream side of the fuel filter and extending externally of the fuel pump module and fuel tank. Preferably, the filter drain conduit is in fluid communication with the filter chamber substantially at a vertically lower portion of the fuel filter. It is also preferred that the filter drain conduit includes a valve located externally of the fuel tank. It is further preferable to provide a heating device in the fuel filter to reduce "parafinning" of diesel fuel on the fuel filter in cold weather conditions. It is also preferable to provide a recirculation device in the drain conduit within the fuel tank to continuously or selectively purge the fuel filter and filter chamber of water.

At least some of the objects, features and advantages that may be achieved by at least certain embodiments of the invention include providing a fuel filter that does not need to be removed, serviced, and re-installed to a vehicle for purging water therefrom; is capable of being mounted within a fuel tank of a vehicle and being drained of water outside the tank while being located within the tank; is capable of being continuously purged of water by a continuous and automatic recirculation device; is capable of being selectively purged of water by a selective and automatic recirculation device; and is of relatively simple design and economical manufacture and assembly, reliable and in service has a long useful life.

Of course, other objects, features and advantages will be apparent in view of this disclosure to those skilled in the art. Various other fuel tank and fuel filter configurations embodying the invention may achieve more or less than the noted objects, features or advantages.

BRIEF DESCRIPTION OF THE DRAWINGS

These and other objects, features and advantages of the present invention will be apparent from the following detailed description of the preferred embodiments and best mode, appended claims, and accompanying drawings in which:

DETAILED DESCRIPTION OF THE PREFERRED EMBODIMENTS

Figure 1:
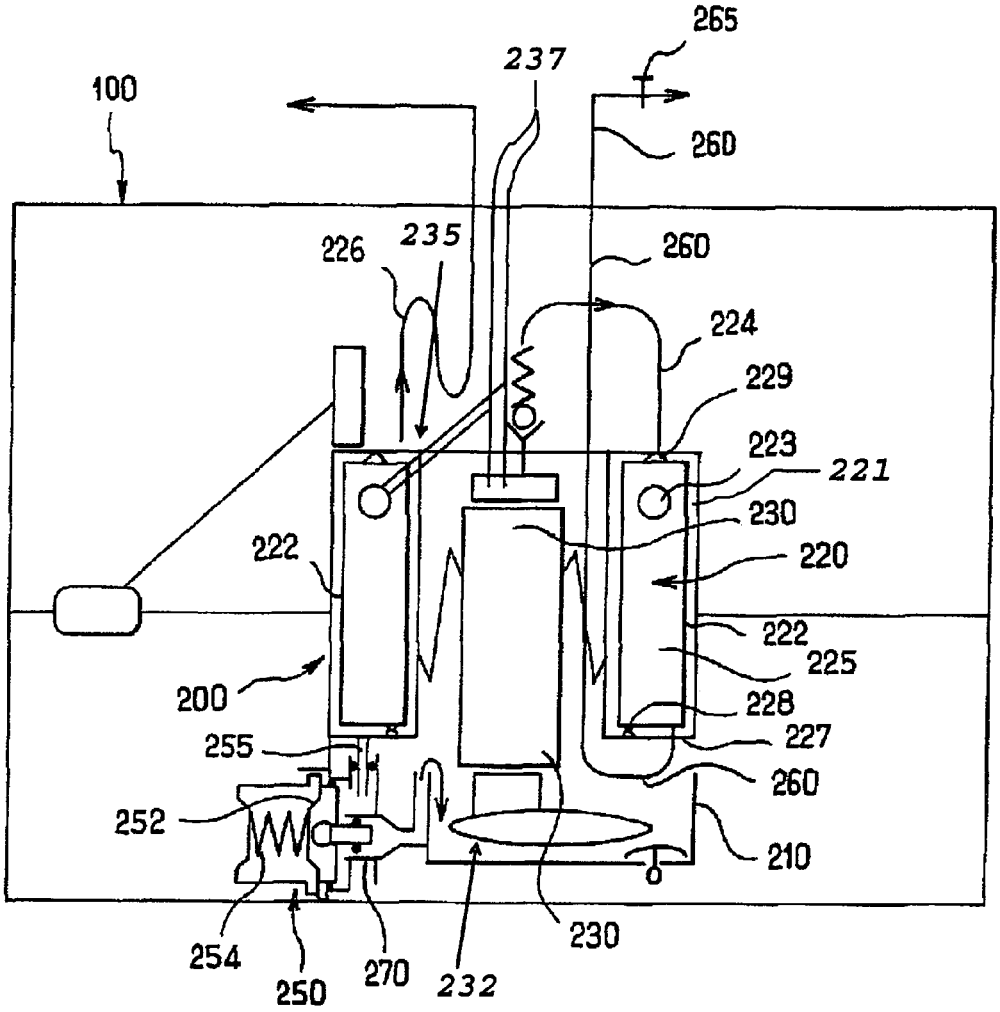
FIG. 1 is a schematic cross-sectional view of a fuel tank assembly having a fuel pump module with a fuel filter according to an exemplary embodiment of the present invention.

Referring in more detail to FIG. 1, there is illustrated a motor vehicle fuel tank assembly including a fuel tank 100 for housing fuel therein and a fuel pump module 200 positioned within the fuel tank 100 in contact with the fuel therein for pumping the fuel out of the fuel tank 100. A flange (not shown) of the module 200 seals an opening (not shown) of the fuel tank 100 through which the module 200 is inserted.

The module 200 includes a housing 210 having a fuel filter module or filter 220 for filtering fuel and a fuel pump 230 for maintaining a predetermined fuel pressure within the module 200. The pump 230 includes a fuel propulsion unit 232 for drawing fuel from the interior of the fuel tank 100 into the housing 210 and delivering it under pressure to an engine of a vehicle (not shown) to which the fuel tank 100 is mounted. A fuel module inlet or jet pump 270 draws fuel from within the fuel tank 100 and discharges the fuel into a lower portion of the housing 210 for use by the fuel pump 230. Accordingly, the fuel pump 230 is downstream of the fuel module inlet or jet pump 270.

The fuel pump 230 delivers fuel downstream through the fuel filter 220, which circumscribes the fuel pump 230 within a filter chamber 221 of the module 200. The filter chamber 221 is in fluid communication with a fuel pressure regulator 250 mounted to the housing 210 that is provided for regulating the output of the fuel module 200. The pressure regulator 250 receives an overflow or overpressure of fuel from the fuel filter 220 and filter chamber 221 when the fuel filter 220 and chamber 221 receives from the fuel pump 230 a quantity of fuel greater than the quantity sent from the fuel pump 230 to the engine. The regulator 250 includes an obturation membrane or a diaphragm-actuated valve 252 that is biased by a spring 254. The spring 254 is dimensioned so as to be resiliently displaceable in response to displacement of the valve 252 when a predetermined threshold pressure is reached (i.e. overpressure) within the housing 210. Under such an overpressure condition, excess fuel flows into the pressure regulator 250 through a conduit 255.

The filter chamber 221 is also in fluid communication with a fuel module outlet or exit conduit 226 in the top of the fuel pump module 200. The fuel pump 230 delivers fuel through an annular casing 222 and filter element 225 that are disposed within the filter chamber 221. The filter element 225 separates the casing 222 into an outer annular portion at an upstream side of the fuel filter 220 and an inner annular portion at a downstream side of the fuel filter 220. Preferably, the filter element 225 is a fine filter element constructed from a folded paper media composed of any desired paper material to capture non-fuel particles. Any other types of filter media may instead be used. In any case, fuel flows downstream into the fuel filter 220 through the outer annular portion of the casing 222 and the filter element 225, and out of the fuel filter 220 through the inner annular portion of the casing 222. Fuel flows further downstream out of the exit conduit 226 in the top of the fuel pump module 200. To this end, fluid-tight seals are provided in contact with the casing 222, including a lower seal 228 and an upper seal 229 of generally triangular cross section. Accordingly, fuel exits the module 200 under pressure and after being filtered for solid contaminants and water present in the fuel.

Because water is heavier than fuel, a layer of water collects or settles in a lower portion of the filter chamber 221 around the outer annular portion of the casing 222 and filter element 225. The level of water increases over time and, likewise, clogs an ever increasing surface area of the filter element 225. With this exemplary embodiment of the present invention, the filter element 225 is efficiently packaged within the fuel pump module 200 within the fuel tank 100, but is inaccessible to a mechanic.

Nonetheless, the fuel filter 220 may be substantially purged or drained of its water and, thus, the fuel module 200 and tank 100 may be substantially drained of its water. A filter drain conduit 260 is provided in fluid communication with the filter chamber 221 at a lower end of the filter 221 through the bottom wall 227 of the casing 222. The drain conduit 260 extends out of the module 200 through a top surface thereof and, likewise, out of the fuel tank 100. A drain valve 265 is positioned in fluid communication with the conduit 260 outside of the fuel tank 100 so that a mechanic may actuate the drain valve 265 to purge the filter element 225 and filter chamber 221 of water. The mechanic first opens the drain valve 265 and then activates the ignition of the vehicle to activate the fuel pump 230 to pressurize fuel downstream of the fuel pump 230, thereby pushing water out of a lower portion of the filter chamber 221, through the drain conduit 260, out of the module 200, and out of the fuel tank 100. The mechanic may observe that an initial discharge of liquid through the drain conduit 260 is water, until the layer of accumulated water in the filter chamber 221 is depleted. Thereafter, the mechanic may notice that fuel starts to discharge through the drain conduit 260, at which point the draining of the fuel filter element 225 and filter chamber 221 is complete. At this point the drain valve 265 may be closed and the vehicle ignition deactivated.

Although not shown in FIG. 1, the drain conduit 260 may include a first section extending from the casing 222 of the fuel filter 220 to an internal nipple (not shown) of a mounting flange (not shown) of the fuel pump module 200 wherein the flange mounts to and closes the opening in the fuel tank 100. An external nipple (not shown) is provided on the mounting flange in fluid communication with the internal nipple, and is easily accessible by the mechanic as it is external of the fuel tank 100. To this end, a trap door may be provided in the vehicle (not shown) above the fuel tank 100 in the vicinity of the portion of the drain conduit 260 that is external with respect to the fuel tank 100. In addition to the nipples, the drain conduit 260 preferably includes tubes of about 2.5 to 3.0 mm in diameter that are preferably composed of polyamide.

In addition to providing an easily serviceable and efficiently packaged fuel filter element 225, the fuel pump module 200 also includes a means for improving cold weather operation of the fuel filter element 225. Certain fuels, like diesel fuels, are particularly viscous and tend to clog or "paraffin" the fuel filter element 225 and block flow therethrough in cold weather conditions. Therefore, the fuel pump module 200 is equipped with a heating device 235, which preferably includes an electrical resistance heating element 223 located preferably within an upper portion of the filter element 225. As is known to those of ordinary skill in the art, the heating device 235 may include electrical wires 237 as shown for providing power from a remote source (not shown) to the heating element 223.

Figure 2:
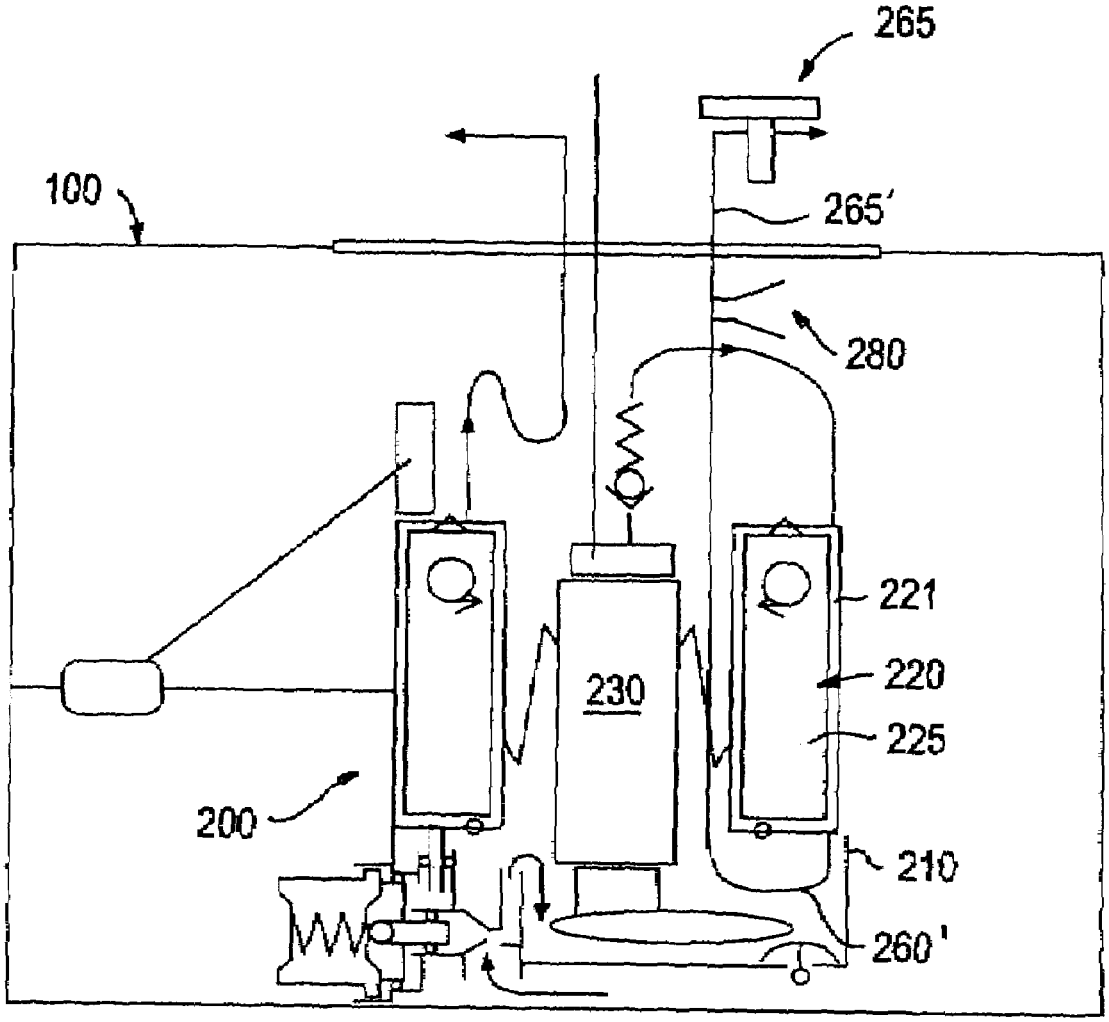
FIG. 2 is a schematic cross-sectional view of a fuel tank assembly having a fuel pump module with a fuel filter according to a second exemplary embodiment of the present invention.

FIG. 2 illustrates another exemplary embodiment of the present invention. This embodiment is similar in many respects to the embodiment of FIG. 1 and like numerals between the embodiments generally designate like or corresponding elements throughout the several views of the drawing figures. Additionally, the common subject matter will generally not be repeated here.

FIG. 2 illustrates a modified drain conduit 260' that includes a recirculation device 280, such as a passage, an aperture, a jet or the like. The recirculation device 280 is in fluid communication with the drain conduit 260', between the housing 210 of the fuel pump module 200 and the drain valve 265, within the fuel tank 100. The size and shape of the recirculation device 280 may be chosen or calibrated so as to automatically remove water from the filter element 225 between manual purges involving a mechanic to open the drain valve 265. Alternatively, however, use of the recirculation device 280 may preclude the need for the drain valve 265 and that portion of the drain conduit 260 that extends out of the fuel tank 100.

In operation, the fuel pump 230 delivers fuel to the fuel filter 220 under pressure as previously described. But because the recirculation device 280 in the drain conduit 260' is always open to at least some predetermined degree, the fluid pressure from the fuel pump 230 also tends to push at least some accumulated water at the lower end of the fuel filter 220 out of the casing 222 and filter chamber 221, through the conduit 260', and into the interior of the fuel tank 100 through the recirculation device 280. The recirculation device 280 thus provides a continuous means to remove water from the fuel filter 220 at a predetermined rate depending on the size and shape of the recirculation device 280. The water that is removed through the recirculation device 280 and discharged into the fuel tank 100 effectively becomes dispersed within the liquid fuel in the fuel tank 100 and may eventually recirculate through the fuel tank 100, into the fuel module 200, out of the fuel module 200, and through the drain conduit 260' and recirculation device 280, wherein the cycle may repeat. This continuous recirculation of water tends to keep the fuel filter 220 clear of large accumulations of water to prevent sudden, or even gradual, releases of water through the filter to the engine, and tends to increase the intervals between drain servicing of the filter wherein a mechanic actuates the drain valve 265 to purge not only the fuel filter 220 of water but also the entire module 200 and tank 100.

Figure 3:
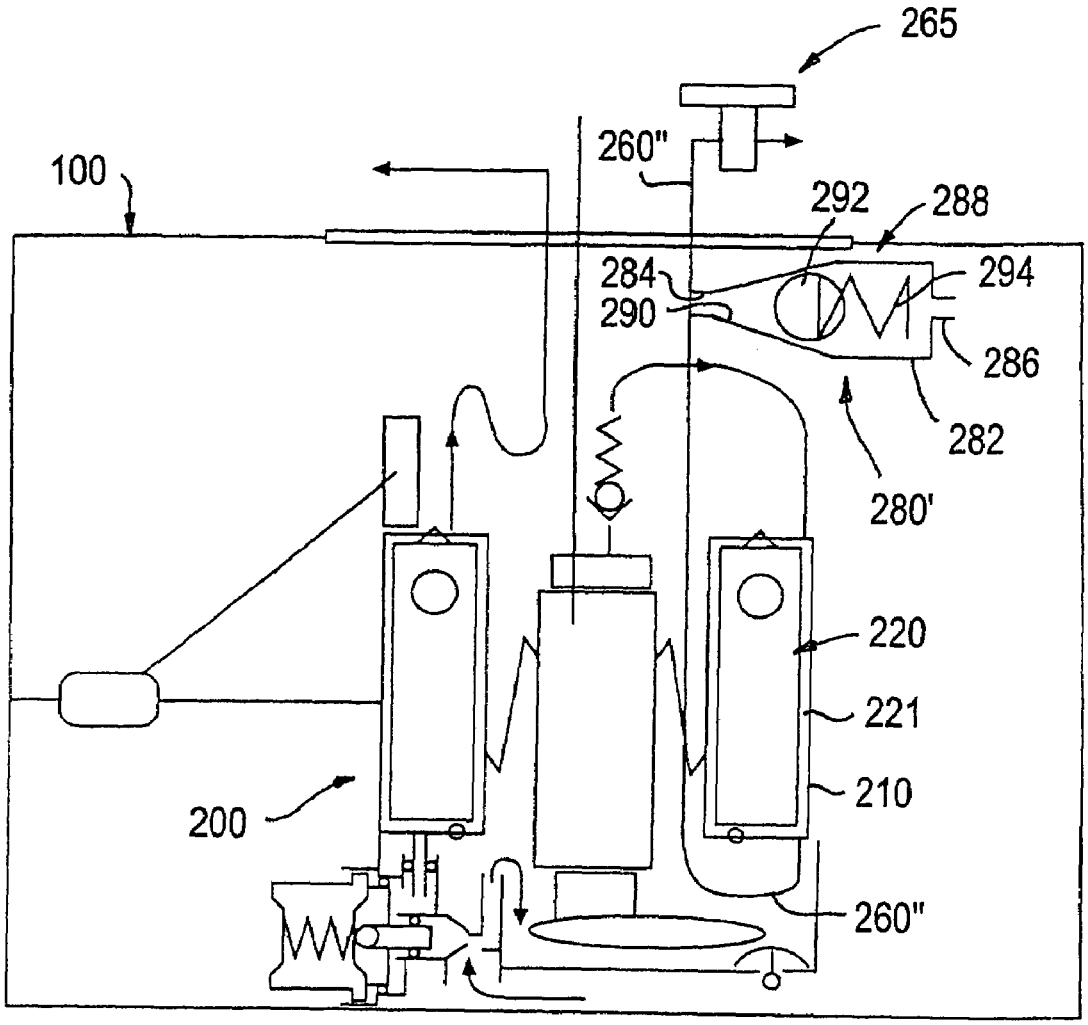
FIG. 3 is a schematic cross-sectional view of a fuel tank assembly having a fuel pump module with a fuel filter according to a third exemplary embodiment of the present invention.

FIG. 3 illustrates a further exemplary embodiment of the present invention. This embodiment is similar in many respects to the embodiments of FIGS. 1 and 2 and like numerals between the embodiments generally designate like or corresponding elements throughout the several views of the drawing figures. Additionally, the common subject matter will generally not be repeated here.

FIG. 3 illustrates another modified drain conduit 260" that includes a recirculation device 280' in fluid communication therewith, between the housing 210 of the fuel pump module 200 and the drain valve 265, within the fuel tank 100. The recirculation device 280' may include a housing 282 generally defining a passage and having an inlet 284 in fluid communication with the drain conduit 260", an outlet 286 in fluid communication with the interior of the fuel tank 100, and a valve 288 in selective fluid communication therebetween. The valve 288 includes a valve seat 290 preferably formed in the housing 282, a ball valve 292 for sealing cooperation with the valve seat 290, and a valve spring 294 between the ball valve 292 and the outlet 286. One or more of the inlet 284, the outlet 286, and any part of the housing 282 in between, may be constructed as a passage, aperture, or jet of any suitable size and shape.

The sizes and shapes of the various features of the recirculation device 280' may be chosen or calibrated so as to automatically remove water from the filter element 225 between manual purges of water involving a mechanic to open the drain valve 265. Alternatively, however, use of the recirculation device 280 may preclude the need for the drain valve 265 and that portion of the drain conduit 260" extending outside of the fuel tank 100. Preferably, the valve 288 of the recirculation device 280' is calibrated to open when a predetermined percentage of the fuel filter 220 is blocked with water and/or other contaminants. As discussed previously, between manual drain service intervals, water tends to accumulate at the lower end of the fuel filter 220. Over time, the level of the accumulated water rises and clogs more and more surface area of the fuel filter 220, thereby impeding fuel flow therethrough and creating a pressure drop across the fuel filter 220. In other words, fluid pressure at the upstream side of the fuel filter 220 will be significantly greater than the fluid pressure at the downstream side of the fuel filter 220. This relatively higher pressure at the upstream side of the fuel filter 220 is communicated to the recirculation device 280' through the drain conduit 260" and, upon reaching a predetermined high pressure threshold, will cause the valve 288 of the recirculation device 280' to open.

The recirculation device 280' operates when the fluid pressure in the drain conduit 260" overcomes the spring force of the spring 294, thereby unseating the ball valve 292 and allowing fluid to pass thereby out of the outlet 286. In other words, the ball valve 292 opens when a predetermined threshold pressure develops within the drain conduit 260" so as to selectively communicate the fuel filter chamber 221 with the interior of the fuel tank 100 through the drain conduit 260". Thus, when the recirculation device 280' operates, accumulated water at the lower end of the fuel filter 220 will tend to flow through the conduit 260", out of the recirculation device 280', and into the interior of the fuel tank 100 for recirculation with the fuel therein. As more and more water is drained through the recirculation device 280', less and less surface area of the fuel filter 220 is clogged with water and, thus, the pressure drop across the fuel filter 220 decreases. When the pressure drop decreases, the fluid pressure at the upstream side of the fuel filter 220 decreases to a magnitude less than the spring force of the valve spring 294, whereupon the ball valve 292 re-seats against the valve seat 290 to close the valve 288 and cease operation of the recirculation device 280'. The cycle repeats when a predetermined portion of the surface area of the fuel filter 220 again becomes clogged with water and/or other contaminants.

While the forms of the invention herein disclosed constitute a presently preferred embodiment, many others are possible. It is not intended herein to mention all the possible equivalent forms or ramifications of the invention. As just one example, the term valve as used herein encompasses all types of suitable flow-control device including but not limited to stopcock valves, check valves, gate valves, globe valves, ball valves, bicuspid valves, butterfly valves, slide valves, spool valves, and any other suitable valves. It is understood that terms used herein are merely descriptive, rather than limiting, and that various changes may be made without departing from the spirit and scope of the invention as defined by the following claims.

What is claimed is:

1. A vehicle fuel tank assembly comprising:
- a fuel tank having an interior;
- a fuel pump module being at least partially disposed within the interior of the fuel tank, the fuel pump module comprising:
  - an inlet;
  - an outlet downstream of the inlet;
  - a fuel pump downstream of the inlet and upstream of the outlet;
  - a fuel filter chamber downstream of the fuel pump;
  - a fuel filter disposed within the fuel filter chamber and having an upstream side and a downstream side; and
- a filter drain conduit in fluid communication with the fuel filter chamber substantially at the upstream side of the fuel filter and extending externally of the fuel pump module and fuel tank.

2. The fuel tank assembly of claim 1 wherein the fuel pump module includes a housing containing the fuel pump and the fuel filter therein.

3. The fuel tank assembly of claim 1 wherein the fuel filter includes a lower portion and further wherein the filter drain conduit is in fluid communication with the filter chamber substantially at the lower portion of the fuel filter.

4. The fuel tank assembly of claim 1 wherein the filter drain conduit includes a valve located externally of the fuel tank.

5. The fuel tank assembly of claim 1 wherein the fuel pump module further includes a heating device.

6. The fuel tank assembly of claim 5 wherein the heating device is a resistance heating element provided in the fuel filter.

7. The fuel tank assembly of claim 1 wherein the drain conduit comprises a recirculation device in fluid communication therewith and with the interior of the fuel tank.

8. The fuel tank assembly of claim 7 wherein the recirculation device comprises a passage that continuously communicates the fuel filter chamber with the interior of the tank through the drain conduit.

9. The fuel tank assembly of claim 7 wherein the recirculation device comprises a passage and a valve disposed therein that opens when a predetermined threshold pressure develops within the drain conduit so as to selectively communicate the fuel filter chamber with the interior of the tank through the drain conduit.

10. A fuel pump module adapted for mounting to a fuel tank within an interior thereof, comprising:

an inlet;

an outlet downstream of the inlet;

a fuel pump downstream of the inlet and upstream of the outlet;

a fuel filter chamber downstream of the fuel pump;

a fuel filter disposed within the fuel filter chamber and having an upstream side and a downstream side; and a filter drain conduit in fluid communication with the fuel filter chamber substantially at the upstream side of the fuel filter and extending externally of the fuel pump module and fuel tank.

11. The fuel pump module of claim 10 further comprising a housing containing the fuel pump and the fuel filter therein.

12. The fuel pump module of claim 10 wherein the fuel filter includes a lower portion and further wherein the filter drain conduit is in fluid communication with the filter chamber substantially at the lower portion of the fuel filter.

13. The fuel pump module of claim 10 wherein the filter drain conduit includes a valve located externally of the fuel tank.

14. The fuel pump module of claim 10 wherein the fuel pump module further includes a heating device.

15. The fuel pump module of claim 14 wherein the heating device is a resistance heating element provided in the fuel filter.

16. The fuel pump module of claim 10 wherein the drain conduit comprises a recirculation device in fluid communication therewith and with the interior of the fuel tank.

17. The fuel pump module of claim 16 wherein the recirculation device comprises a passage that continuously communicates the fuel filter chamber with the interior of the tank through the drain conduit.

18. The fuel pump module of claim 16 wherein the recirculation device comprises a passage and a valve disposed therein that opens when a predetermined threshold pressure develops within the drain conduit so as to selectively communicate the fuel filter chamber with the interior of the tank through the drain conduit.

19. A fuel filter adapted for use with a fuel pump module having a filter chamber, an outlet, and a drain conduit extending externally thereof, comprising:

a downstream side in fluid communication with the outlet of the fuel pump module;

an upstream side in fluid communication with the fuel pump and the drain conduit; and a heating device.

20. The fuel filter of claim 19 wherein the heating device is a resistance heating element.

* * * * *